US007897864B2

(12) United States Patent
Akiyama

(10) Patent No.: US 7,897,864 B2
(45) Date of Patent: Mar. 1, 2011

(54) BAND EXTENSION REPRODUCING APPARATUS

(75) Inventor: Hitoshi Akiyama, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 234 days.

(21) Appl. No.: 12/258,994

(22) Filed: Oct. 27, 2008

(65) Prior Publication Data

US 2009/0107322 A1 Apr. 30, 2009

(30) Foreign Application Priority Data

Oct. 25, 2007 (JP) ..... 2007-277166

(51) Int. Cl.
*G10H 1/00* (2006.01)

(52) U.S. Cl. ..... 84/616; 84/622; 84/648; 84/654; 84/659

(58) Field of Classification Search ..... 84/600–602, 84/608, 616, 622–625, 648, 654, 659–666
See application file for complete search history.

(56) References Cited

U.S. PATENT DOCUMENTS 5,218,156 A * 6/1993 Ilzuka et al. ..... 84/624
5,231,288 A * 7/1993 Odell ..... 250/336.1
RE34,481 E * 12/1993 Ishibashi ..... 84/605
5,490,233 A * 2/1996 Kovacevic ..... 704/230
7,476,797 B2 * 1/2009 Izumisawa et al. ..... 84/660
2004/0037571 A1 * 2/2004 Iida et al. ..... 398/192
2008/0130915 A1 * 6/2008 Shimura et al. ..... 381/102
2008/0170719 A1 * 7/2008 Shimura et al. ..... 381/94.1
2008/0292114 A1 * 11/2008 Shimura et al. ..... 381/103
2009/0107322 A1 * 4/2009 Akiyama ..... 84/616
2010/0017198 A1 * 1/2010 Yamanashi et al. ..... 704/205

FOREIGN PATENT DOCUMENTS

JP 4-245062 A 9/1992
JP 06095678 A * 4/1994
JP 2001-356788 A 12/2001
JP 2003-15695 A 1/2003

* cited by examiner

*Primary Examiner* — David S. Warren
(74) *Attorney, Agent, or Firm* — Crowell & Moring LLP

(57) ABSTRACT

Signals in two different bands (band components) are extracted from an input signal by an HPF and a BPF, and frequency-shift processing is performed by an MPY. Further, in order to adjust levels of an interface between the band components of shifted frequency to a high-frequency band side and the input signal, band components with which the input signal is adjacent to the high-frequency band extension components are extracted by an HPF. Then, a gain is controlled on the basis of the output values from the HPF and the HPF so as to reduce a difference between the components of shifted frequencies and the level of the input signal by the level correction coefficient calculating unit and the MPY. Then, the shifted components are added to the high-frequency band of the input signal by an ADDER.

8 Claims, 8 Drawing Sheets

BAND EXTENSION REPRODUCING APPARATUS

BACKGROUND OF THE INVENTION

The present invention relates to an apparatus in which high-frequency band components are newly generated with respect to an input signal, and those are added to a high-frequency band of the input signal to generate a signal with a wideband frequency characteristic.

As is commonly known, a music signal before being transformed into a digital signal continues as spectral envelope so as to naturally attenuate integer-order harmonic overtone series components up to a high-frequency band. Further, there are noninteger-order harmonic components and noise in a music signal. FIGS. 1A and 1B show spectrums before and after an audio signal of certain orchestra music is recorded on a compact disk (hereinafter called CD). As shown in FIG. 1A, it can be understood that high-intensity harmonic components continue up to a high-frequency band at a constant frequency interval in the audio signal before being recorded on the CD. This frequency interval is determined on the basis of a fundamental pitch of a musical instrument.

On the other hand, a frequency band which a digital audio system can reproduce is only half of a sampling frequency to a maximum due to the sampling theorem. For example, as shown in FIG. 1B, in a case of a CD, because its sampling frequency is 44.1 kHz, the frequency characteristic is band-limited to 22.05 kHz.

A characteristic from a sense of listening to a CD sound is expressed by words such as "hard" or "cold" in very many cases as compared to sound from an analog audio system. It has been often pointed out and discussed that such a sense of listening different from that of an analog audio system may be "partly because of band limitations due to the sampling theorem." Further, a phenomenon called "hypersonic effect," in which inaudible band sounds greater than or equal to 20 kHz have a favorable effect on the brain's blood flow has been studied and reported. Against this background, there are an increasing number of needs for extending a band of a signal whose high-frequency band is band-limited to a high-frequency band.

As such, proposals and products in which a band is extended by reproducing a lost high-frequency band to improve a sense of listening have already emerged in large numbers. The methods can be roughly divided into "interpolation techniques" and "high-frequency band addition techniques."

In "interpolation techniques," after upsampling of an input signal to be doubled or more, a new sample derived by a polynomial interpolation technique or a unique technique is added between samples to extend a frequency band.

The "high-frequency band addition techniques" can be roughly classified into three types as in Patent Document Publications which will be described below.

1. A technique in which an input signal is directly squared and cubed to generate higher harmonics, and only a high-frequency band is taken out of the components thereof, to be added as high-frequency band extension components to the input signal to extend its band (refer to JP2001-356788A).
2. A technique in which components in which an input signal is band-limited by a BPF (Band Pass Filter) is rectified and noise generated by a dither generating circuit are put together to be added as high-frequency band extension components to the input signal (refer to JP-Hei4-245062A).

3. A technique in which an input signal is once transformed into a frequency domain to derive a spectrum, and the derived spectrum is evenly divided into several bands, and a correlation with a band serving as a reference is derived to set a highly-correlated band to high-frequency band extension components, and after those are added to the input signal, this is transformed into a time domain as an output signal (refer to JP2003-15695A).

However, there has been the problem that higher harmonics generated by the "interpolation techniques" are basically folding components of existing components, and are not a reproduction of a correct harmonic overtone series harmonic structure.

On the other hand, there has been the following problems in the "high-frequency band addition techniques." That is, when the technology disclosed in JP2001-356788A has a harmonic structure composed of only integer-order harmonics due to synthesis of sine waves, it is possible to generate high-frequency band extension components keeping a correct harmonic overtone series interval by square/cube calculations. However, usually, a music signal is hardly composed of only integer-order harmonics, but includes many noninteger-order harmonics and noise components. In particular, in a low-frequency band, there are many noninteger-order harmonic components due to percussion instruments. Therefore, when such a signal is squared, excessive frequency components are generated in large numbers in addition to higher harmonics with a correct harmonic overtone series interval. Further, generally, in an acoustic digital system, because a maximum absolute value amplitude is handled as 1.0 and a minimum absolute value amplitude is handled as 0.0, when a squared calculation is performed, amplitudes of components to be generated exponentially decrease (ex:$0.1^2$=0.01). Therefore, when components generated by square/cube calculations onto an input signal are added as high-frequency band extension components to the input signal, there has been a problem that a gap is generated in a spectral envelope, which brings an unnatural frequency characteristic.

In the technology disclosed in JP-Hei4-245062A, in a case in which higher harmonics are generated by nonlinear processing such as full-wave rectification, half-wave rectification, or clipping in a digital system, the higher harmonics generate folding distortion at a Nyquist frequency (the half of a sampling frequency) by necessity. Therefore, there has been a problem that the folding distortion is mixed as unnecessary noise into a band of an original signal.

In the technology disclosed in JP2003-15695A, an FFT (Fast Fourier Transformation) calculation is required in order to make a transformation from a time domain into a frequency domain, and a buffer for frame processing is required. Further, it is necessary to increase the number of FFT points in order to precisely analyze a frequency, and a buffer capacity as well increases with an increase in the number of FFT points. Moreover, an inverse FFT calculation is required in order to transform a signal processed in a frequency domain into a time domain again. As a result, there has been a problem that processing load increases, which may be impossible to mount those with the capability of a DSP mounted in consumer audio equipment.

SUMMARY OF THE INVENTION

Then, in view of the problems in the existing band extension techniques as described above, an object of the present invention is to provide a band extension reproducing apparatus in which high-frequency band components with a correct harmonic structure are generated from an input signal by processing in only a time domain in which processing load is relatively light, and those are added to a high-frequency band of the input signal to reproduce a wideband frequency characteristic, which makes it possible to generate a signal with a greater natural characteristic.

The present invention includes the following configurations as means for solving the above-described problems.

(1) A band extension reproducing apparatus comprising:

a high-frequency band component extraction unit which extracts, from an input signal, a high-frequency band component at a predetermined frequency or more;

a first shifter which acquires information on a harmonic overtone series interval from the input signal, and shifts frequency of the extracted high-frequency band component on the basis of the acquired information to generate first high-frequency band extension component; and an adder which adds the generated first high-frequency band extension component to the input signal.

(2) The band extension reproducing apparatus according to (1), further comprising:

a level corrector which corrects levels of the generated first high-frequency band extension component so as to be adapted to a level fluctuation in the input signal to even up a level difference; and a delay unit which delays the input signal to adjust a timing of supplying the input signal and an output signal from the level corrector to the adder, wherein the adder adds the input signal delayed by the delay unit and the first high-frequency band extension component output from the level corrector.

(3) The band extension reproducing apparatus according to (2), further comprising a single-stage or multistage extension processing unit, wherein the multistage extension processing unit includes:

a second shifter which:

acquires information on a harmonic overtone series interval from the input signal, when the extension processing unit is not connected to the previous stage, shifts frequency of the first high-frequency band extension component corrected by the level corrector to a band in proximity to a maximum frequency among the first high-frequency extension component on the basis of the information, when the extension processing unit is connected to the previous stage, shifts a frequency of a second high-frequency band extension component output from the extension processing unit to a band in proximity to a maximum frequency among the second high-frequency extension component on the basis of the information, and outputs a third high-order extension component frequency-shifted from the first or second high-frequency band extension component;

an adjacent component extraction unit which extracts a band component, which is adjacent to the third high-order extension component, from the first or second high-frequency band extension component;

a coefficient calculator which calculates a coefficient to correct levels of the third high-order extension component on the basis of the third high-order extension component output from the second shifter and the band component output from the adjacent component extraction unit; and a second level corrector which corrects levels of the third high-order extension component output from the second shifter so as to be adapted to a level fluctuation in the first or second extension component on the basis of the coefficient calculated by the coefficient calculator to reduce a level difference, wherein the adder adds the input signal, the first high-frequency band extension component output from the level corrector and the third extension component, and the third high-order extension component output from the second level corrector, and wherein the delay unit delays the input signal and the high-order extension component from the respective extension processing unit except for the last-stage one, to adjust the timing to supply the input signal and the high-order extension component to the adder.

(4) The band extension reproducing apparatus according to (2), further comprising:

an adjacent component extraction unit which extracts, from the input signal, a band component which is adjacent to the first high-frequency band extension component; and a coefficient calculator which calculates a coefficient to correct levels of the first high-frequency band extension component on the basis of the first high-frequency band extension component output from the shifter and the band component output from the adjacent component extraction unit, wherein the level corrector corrects levels of the first high-frequency band extension component output from the shifter so as to be adapted to a level fluctuation in the input signal to even up a level difference on the basis of the coefficient calculated by the coefficient calculator.

(5) The band extension reproducing apparatus according to (1), wherein the shifter includes:

a carrier extraction unit which extracts a band component within a constant range centering on a frequency obtained by subtracting the predetermined frequency from a frequency in the first high-frequency band extension component; and an extension component generator which multiplies the frequency band component extracted by the high-frequency band component extraction unit by the carrier component extracted by the carrier extraction unit to output the first high-frequency band extension component in which frequency of the high-frequency band component is shifted to a high-frequency band.

86) The band extension reproducing apparatus according to (5), wherein the carrier extraction unit extracts a minimum range including at least one of integer-order harmonic components of a fundamental pitch of a musical instrument by necessity whatever frequency is selected, as the band component within a constant range.

(7) The band extension reproducing apparatus according to (4), wherein the coefficient calculator includes:

a first envelope detector which derives an envelope on the basis of an instantaneous value of a band component extracted by the adjacent component extraction unit, which is adjacent to the first high-frequency band extension component, and outputs it as a first level value, a second envelope detector which derives an envelope on the basis of an instantaneous value of the first high-frequency band extension component output from the shifter, and outputs it as a second level value, and an operation unit which detects a level difference between the first and second output values to calculate a coefficient for correcting levels of the high-frequency band extension component so as to even up the difference.

(8) The band extension reproducing apparatus according to (1), further comprising a line spectrum enhancing unit which eliminates uncorrelated signals from the input signal to output a highly-correlated component at a subsequent stage of the shifter.

According to the invention, in the band extension reproducing apparatus, the high-frequency band component extraction unit extracts high-frequency band components at the constant frequency or more including harmonic overtone series which must exist in the high-frequency band extension components to be newly generated, as band components serving as origins of the high-frequency band extension components, from the input signal, and the shifter extracts carrier components from the input signal so as to have a harmonic overtone series interval match the input signal when the high-frequency band extension components are added to the input signal, and frequency-shifts the high-frequency band components by using the carrier component to generate high-frequency band extension components. Accordingly, because the carrier components are extracted from the input signal so as to have a harmonic overtone series interval match the input signal when the high-frequency band extension components are added to the input signal, it is possible to grasp how much the high-frequency band extension components should be shifted, which makes it possible to generate high-frequency band extension components with a harmonic-structurally correct harmonic overtone series interval. Further, it is possible to prevent unnecessary noise from being generated in the high-frequency band extension components by the high-frequency band component extraction unit. Moreover, because only the time domain processing is executed, processing load can be suppressed as compared to a technique using frequency domain processing. In accordance therewith, it is possible to reproduce sound with greater natural listening characteristics.

According to the invention, the level corrector corrects the levels of the high-frequency band extension components output from the shifter so as to be well-adapted to a level fluctuation at a high-frequency band end in the input signal to reduce a level difference. Further, the delay unit delays the input signal to be supplied to the adder to adjust the timing to supply the input signal and the output signal from the level corrector to the adder, and the adder adds the input signal and the high-frequency band extension components whose levels are corrected by the level corrector. Accordingly, it is possible to generate high-frequency band extension components with a harmonic-structurally correct harmonic overtone series interval without a level difference or a time difference between the input signal and the high-frequency band extension components. Moreover, because only the time domain processing is executed, processing load can be suppressed as compared to a technique using frequency domain processing. In accordance therewith, it is possible to reproduce sound with greater natural listening characteristics.

According to the invention, the band extension reproducing apparatus is multistage extension processing units, and generates high-order extension components to extend a signal to a higher-frequency band by using the low-order extension components. Accordingly, it is possible to newly add a plurality of high-frequency band extension components to the input signal, which makes it possible to generate a signal with an extremely wideband.

According to the invention, the adjacent component extraction unit extracts band components with which the input signal is adjacent to the high-frequency band extension components, the coefficient calculator calculates a coefficient to correct the levels of the high-frequency band extension components on the basis of the high-frequency band extension components output from the shifter and the band components output from the adjacent component extraction unit, and the level corrector corrects the levels of the high-frequency band extension components output from the shifter so as to be well-adapted to a level fluctuation at the high-frequency band end in the input signal on the basis of the coefficient calculated by the coefficient calculator, to reduce a level difference. Accordingly, it is possible to generate high-frequency band extension components which are smoothly connected to the input signal serving as existing components.

According to the invention, in the shifter, the carrier extraction unit extracts band components within a constant range centering on a frequency in which the constant frequency is subtracted from a frequency in a high-frequency band in which the high-frequency band extension components are added to the input signal as carrier components, in order to frequency-shift the high-frequency band components to the high-frequency band to which the high-frequency band extension components are added, and the extension component generator outputs the high-frequency band extension components frequency-shifted to the high-frequency band by multiplying the high-frequency band components extracted by the high-frequency band component extraction unit by the carrier components extracted by the carrier extraction unit. The high-frequency band components extracted by the high-frequency band component extraction unit are possible by frequency-shift by using sine waves of approximately 11 kHz to 12 kHz as a carrier. However, in a music signal whose harmonic overtone series interval varies with time, a correct harmonic overtone series interval cannot be obtained by frequency-shift by sine waves at a fixed frequency. In the present invention, in order to avoid this, a band in which information on a harmonic overtone series interval can be acquired from the input signal is extracted as a carrier by the carrier extraction unit to generate high-frequency band extension components. Accordingly, it is possible to generate high-frequency band extension components in which the harmonic overtone series in the existing components continue up to a high-frequency band correctly.

According to the present invention, by extracting a minimum range including at least one of integer-order harmonic components of a fundamental pitch of a musical instrument for whatever frequency is selected, it is possible to acquire information on a harmonic overtone series interval from the input signal. Accordingly, by using the band components as a carrier, it is possible to frequency-shift the high-frequency band components to a band in proximity to the maximum frequency while the high-frequency band components extracted by the high-frequency band component extraction unit keeps a correct harmonic overtone series interval. Further, by cutting out components other than the integer-order harmonic overtone series in a low-frequency band by limiting a band, it is possible to prevent unnecessary components from being generated after the frequency-shift.

According to the invention, in the coefficient calculator, the first envelope detector derives an envelope on the basis of an instantaneous value of band components extracted by the adjacent component extraction unit, with which the input signal is adjacent to the high-frequency band extension components, and outputs it as a level value, the second envelope detector derives an envelope on the basis of an instantaneous value of the high-frequency band extension components output from the shifter, and outputs it as a level value, and the operation unit detects a level difference between the output values from the first envelope detector and the second envelope detector to calculate a coefficient to correct the levels of the high-frequency band extension components so as to even up the difference. Accordingly, it is possible to generate high-frequency band extension components with a spectral envelope smoothly connected to the input signal.

According to the invention, the band extension reproducing apparatus includes the line spectrum enhancing unit for eliminating uncorrelated signals from the input signal to output highly-correlated components at the subsequent stage of the shifter. Therefore, harmonic overtone series higher harmonics whose unnecessary components are suppressed can be used as a carrier, which makes it possible to prevent unnecessary components from being generated in an output from the frequency-shift and multiplication.

According to the present invention, because carrier components are extracted from the input signal, it is possible to grasp how much high-frequency band extension components should be shifted, which makes it possible to generate high-frequency band extension components with a harmonic-structurally correct harmonic overtone series interval. Further, because nonlinear processing such as rectification or clipping is not used for generating high-frequency band extension components, it is possible to prevent excessive noise from being generated, and because the levels of the generated high-frequency band components are adaptively adjusted to the levels of the original components, it is possible to reduce a shift in the spectral envelope. Because only the time domain processing is executed, processing load can be eased as compared to a technique using frequency domain processing. Accordingly, because high-frequency band components having a correct harmonic structure are generated from an input signal by processing only within a time domain in which processing load is relatively light, and those are added to a high-frequency band of the input signal to reproduce a wideband frequency characteristic, it is possible to provide sound with greater natural listening characteristics.

DETAILED DESCRIPTION OF PREFERRED EMBODIMENTS

Figure 2A:
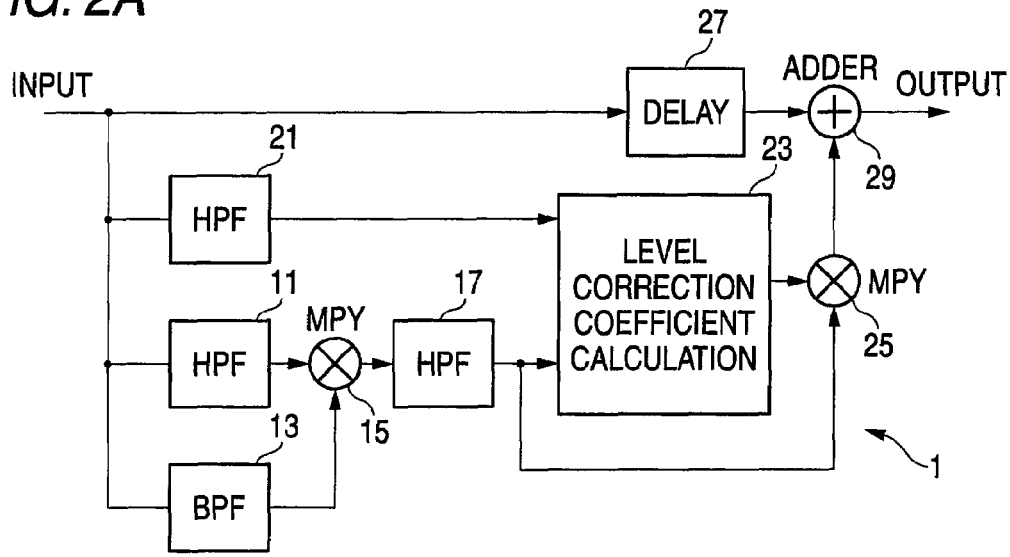
FIG. 2 shows block diagrams schematically illustrating the configuration of a band extension reproducing apparatus according to an embodiment of the present invention.
Figure 2B:
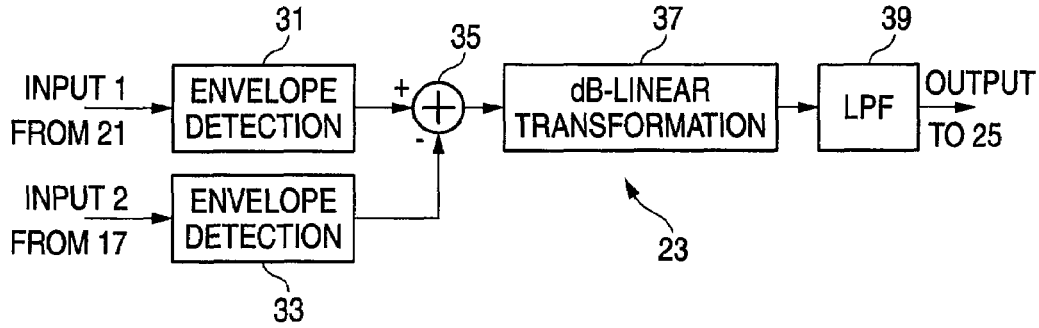
Figure 2C:
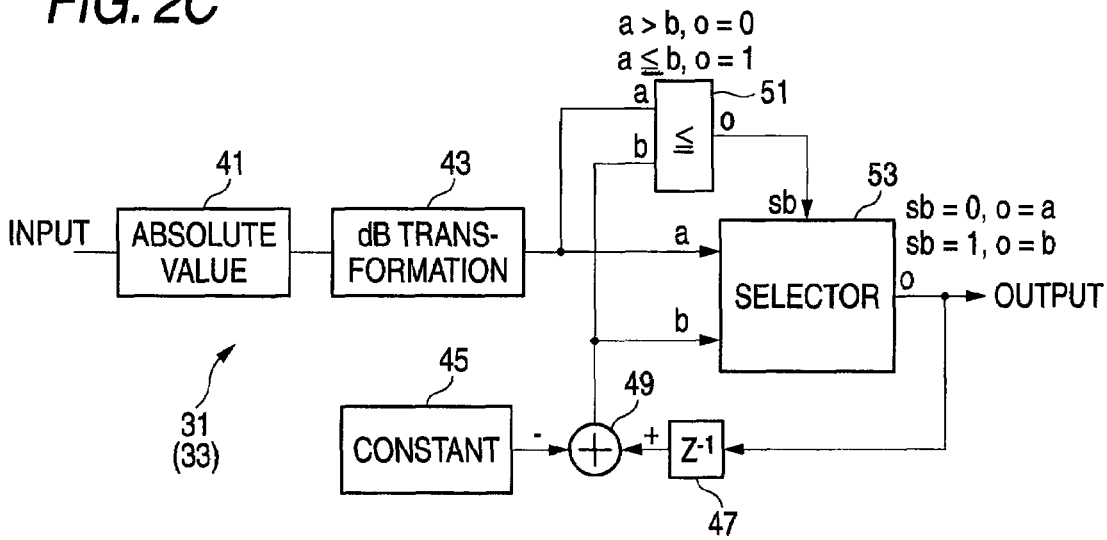
Figure 3:
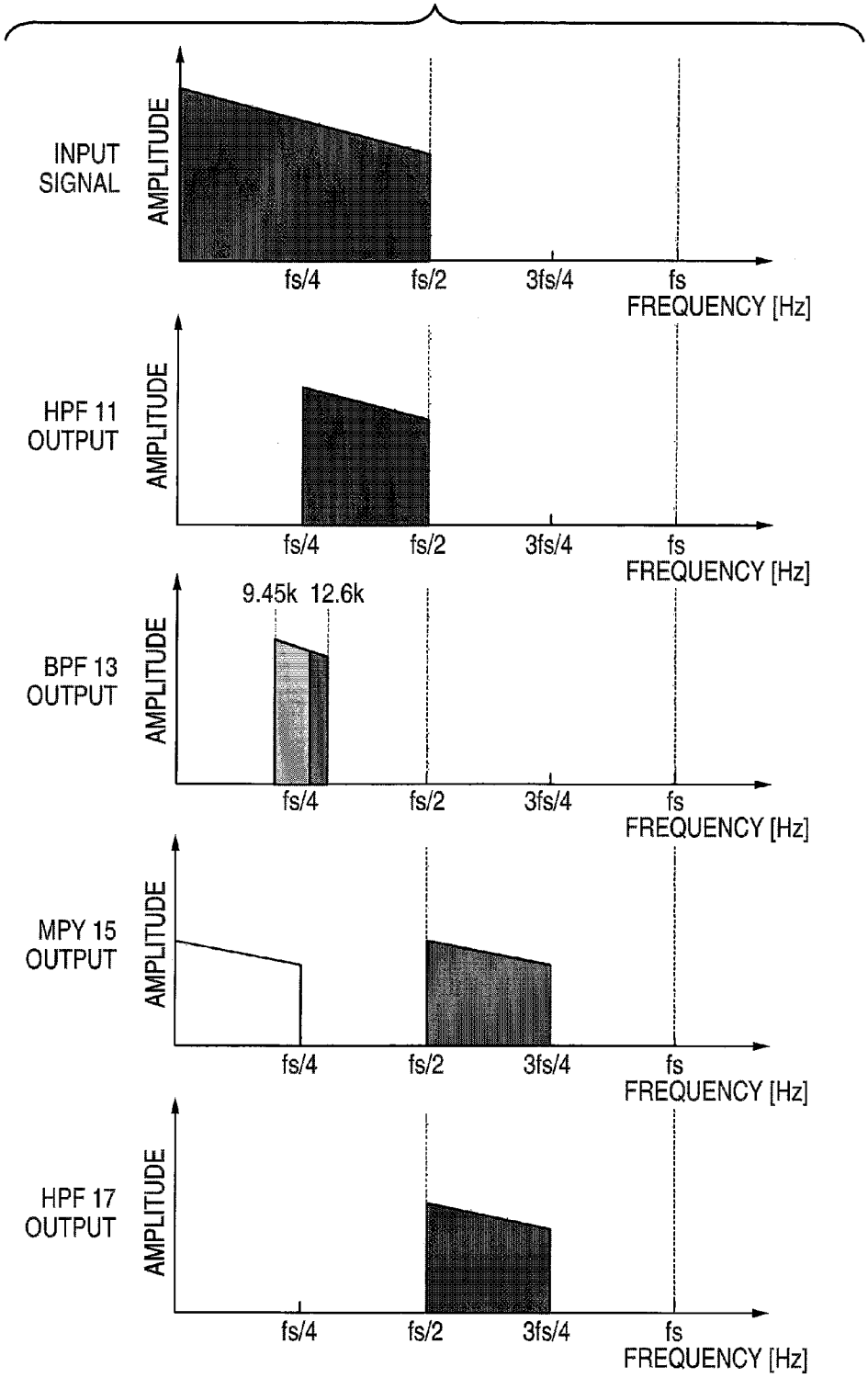
FIG. 3 shows charts indicating input and output signals of respective parts at the previous stage portion in the band extension reproducing apparatus.
Figure 4A:
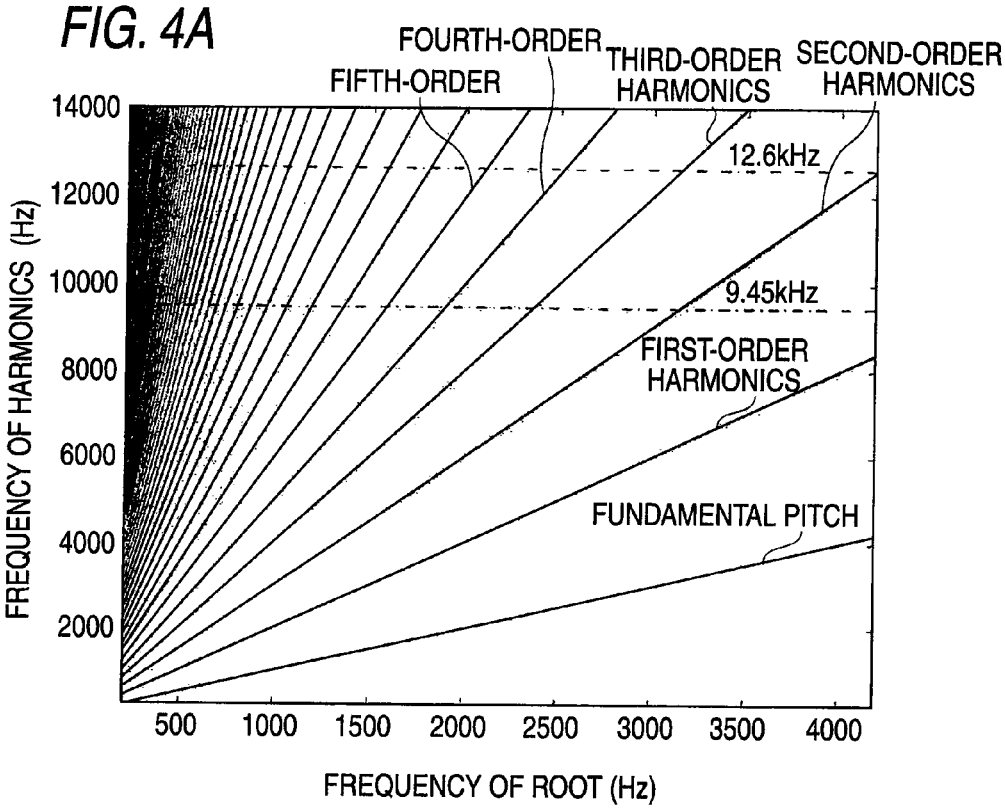
FIG. 4A is a graph showing a fundamental pitch of a musical instrument and integer-order harmonics thereof.
Figure 4B:
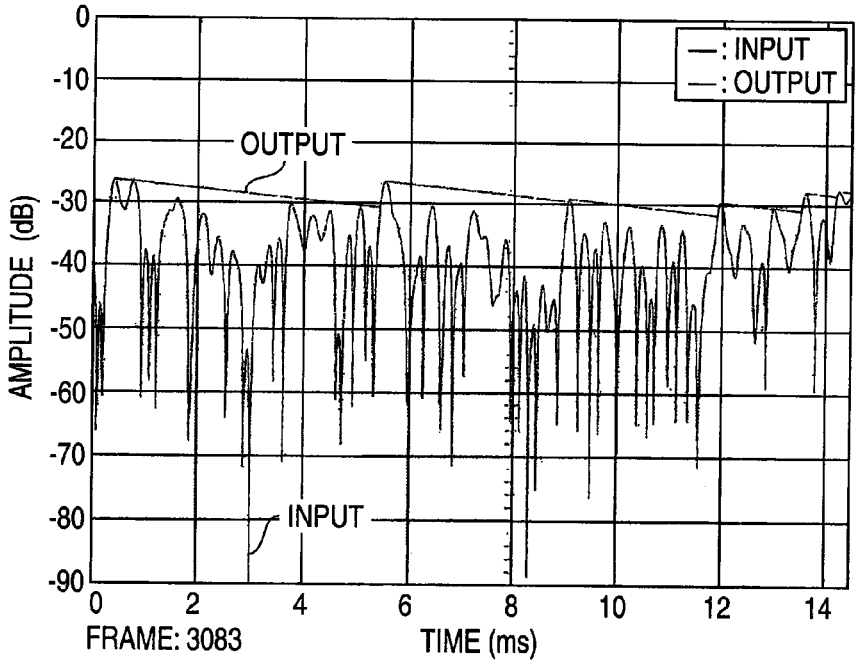
FIG. 4B is a graph indicating input and output signals of envelope detection.

FIGS. 2A to 2C show block diagrams schematically illustrating the configuration of a band extension reproducing apparatus according to an embodiment of the present invention. FIG. 2A is a block diagram illustrating the entire configuration of the band extension reproducing apparatus, FIG. 2B is a block diagram illustrating the configuration of a level correction coefficient calculating unit, and FIG. 2C is a block diagram illustrating the configuration of an envelope detecting unit. FIG. 3 shows charts indicating input and output signals of respective parts of the band extension reproducing apparatus. FIG. 4A is a graph showing a fundamental pitch of a musical instrument and integer-order harmonics thereof, and FIG. 4B is a graph indicating input and output signals of envelope detection.

In the following description, an example of an audio band extension reproducing apparatus that executes processing for making an audio signal whose high-frequency band is band-limited to have a wider-band will be described as one example of a band extension reproducing apparatus.

Note that, in FIG. 2A, it is assumed that upsampling of an input signal to the audio band extension reproducing apparatus is performed to double it or more in the previous step, and unnecessary folding components generated at that time are already eliminated by a low-pass filter. Further, it is assumed that a sampling frequency of the input signal before upsampling is fs (which is 44.1 kHz as an example of concrete value), and the input signal to the audio band extension reproducing apparatus is a signal whose high-frequency band is band-limited, and is less than or equal to fs/2 as shown in FIG. 3 (input signal).

As shown in FIG. 2A, an audio band extension reproducing apparatus (hereinafter called reproducing apparatus) 1 includes a high-pass filter (hereinafter called HPF) 11 serving as a high-frequency band component extraction unit, a band-pass filter (hereinafter called BPF) 13 serving as a carrier extraction unit, a multiplier (hereinafter called MPY) 15 and an HPF 17 serving as an extension component generator, an HPF 21 serving as an adjacent component extraction unit, a level correction coefficient calculating unit (hereinafter called coefficient calculating unit) 23 serving as a coefficient calculator, an MPY 25 serving as a level corrector, a delay unit 27 serving as a delay unit, and an adder unit (hereinafter called ADDER) 29 serving as an adder.

Figure 1A:
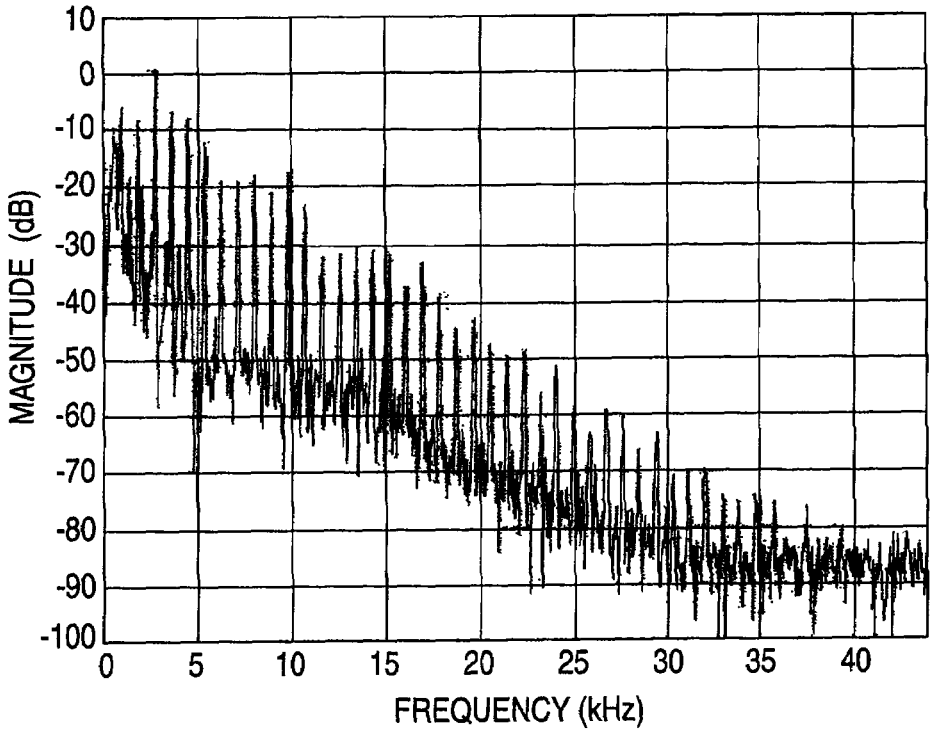
FIG. 1 shows spectrums before and after an audio signal of a certain orchestra music is recorded on a compact disk.

The HPF 11 extracts high-frequency band components serving as an origin of high-frequency band extension components from the input signal. In the present invention, in order to reproduce a harmonic overtone series in a band greater than or equal to fs/2, a high-frequency band signal whose harmonic overtone series components exist dominantly over the other components is used in a band less than or equal to fs/2. That is, as shown in FIG. 1A, a harmonic overtone series existing in a band greater than or equal to fs/2 (22.05 kHz), which originally remains in a high-frequency band (for example, a band greater than or equal to fs/4 (11.025 kHz)) continues in most cases. On the other hand, for example, a harmonic overtone series existing in a band less than or equal to fs/4 includes components which are already attenuated or which do not exist in a band greater than or equal to fs/2. Therefore, in the present invention, band components serving as origins of high-frequency band extension components are extracted from a high-frequency band portion of an audio signal. For example, as shown in FIG. 3 (output of HPF 11), a band greater than or equal to fs/4 is used.

The BPF13 extracts a component used as a carrier so as to shift the component extracted by the HPF 11 to a high-frequency band in proximity to fs/2, i.e., such that a low-frequency band side of the component extracted by the HPF 11 nears fs/2. Provided that a sine wave of approximately 11 kHz to 12 kHz is used as a carrier, it is possible to frequency-shift such that a low-frequency band side of the component extracted by the HPF 11 nears fs/2. However, in a music signal whose harmonic overtone series interval varies with time, a correct harmonic overtone series interval cannot be obtained by frequency-shift by using a sine wave at a fixed frequency. Then, in the present invention, in order to avoid this problem, a band which can be used as a carrier is extracted by the band-pass filter from a frequency in a high-frequency band of the input signal. The extracted band is within a predetermined range centering on a frequency obtained by subtracting a lowermost frequency (fs/4) of a high-frequency band component extracted by the HPF 11 from a frequency in a high-frequency band to be added to the input signal. That is, because information on the harmonic overtone series interval is acquired from the input signal, it can be understood how much the high-frequency band extension components should be shifted at the time of shifting it, which makes it possible to generate high-frequency band extension components with a harmonic-structurally correct (harmonic) harmonic overtone series interval.

In a graph shown in FIG. 4A, frequencies of a fundamental pitch are plotted on the abscissa, and frequencies of integer-order harmonics thereof are plotted on the ordinate. A fundamental pitch is set to be in a range from 200 Hz to 4.2 kHz. This is because the highest note of a piano is generally the highest frequency as a fundamental pitch among acoustic instruments, and its frequency is approximately 4.2 kHz.

It can be understood from FIG. 4A that a band from 9.45 kHz to 12.6 kHz is a minimum range including at least one of integer-order harmonic components (harmonic overtone components) of the fundamental pitch of the instrument by necessity for whatever frequency is selected. Accordingly, when a sampling frequency fs is 44.1 kHz, provided that the band from 9.45 kHz to 12.6 kHz is extracted by the BPF to be used as a carrier, it is possible to frequency-shift a high-frequency band component extracted by the HPF 11 to a band above a band from approximately 9 kHz to 12 kHz (i.e., in proximity to 22 kHz which is the maximum value of the input signal) while keeping a correct harmonic overtone series interval of the output component from the HPF 11. Further, there is an effect to prevent unnecessary components from being generated after frequency-shift by cutting out components other than the integer-order harmonic overtone series in a low-frequency band by limiting the band.

Note that, as shown in FIG. 3 (output of BPF 13), a median frequency in a range from 9.45 kHz to 12.6 kHz is fs/4 (11.025 kHz). Further, when a band extracted by the BPF 13 is narrower than the above-described range, a case in which none of the integer-order harmonic components of a fundamental pitch of a musical instrument is included may be caused, and when a band extracted by the BPF 13 is wider than the above-described range, many unnecessary components are included at the time of frequency-shift, which leads to the above-described range as optimum values.

The MPY 15 multiplies an output from the HPF 11 by an output from the BPF 13 as a carrier to frequency-shift the components extracted by the HPF 11 to a band in proximity to the maximum frequency of the input signal so as to have a harmonic overtone series interval match the input signal when a high-frequency band extension component is added to the input signal.

$$A_1\sin(\omega_1 t+\phi_1)\times A_2\sin(\omega_2 t+\phi_2)= \quad \text{Formula 1}$$

-continued $$\frac{A_1A_2}{2}[\cos\{(\omega_1+\omega_2)t+\phi_1+\phi_2\}-\cos\{(\omega_1-\omega_2)t+\phi_1-\phi_2\}]$$

Note that, as understood from a multiplication formula of sine waves, the multiplied component includes both of the components shifted to the high-frequency band side and the components shifted to the low-frequency band side (refer to FIG. 3 (output of MPY 15)).

Because the components shifted to the low-frequency band side among the output components from the MPY 15 are unnecessary, the HPF17 extracts only the components shifted to the high-frequency band side to output those to the coefficient calculating unit 23 and the MPY 25. A cutoff frequency is set to a frequency slightly lower than fs/2. Thereby, as shown in FIG. 3 (output of HPF 17), high-frequency band extension components whose band components are fs/2 to 3 fs/4 are generated.

The HPF 21 extracts a band in which the input signal is adjacent to the high-frequency band extension components. This is because the levels of an interface between the high-frequency band extension components and the input signal are adjusted to finely connect those. That is, the HPF 21 extracts high-frequency band components with which the input signal is adjacent to the high-frequency band extension components to output those to the coefficient calculating unit 23, which makes it possible to correct the level of the high-frequency band extension components output from the HPF 17 on the basis of the high-frequency band components extracted by the HPF 21 in the coefficient calculating unit 23. For example, a value of approximately fs/3 is set as a cutoff frequency to the HPF 21.

The coefficient calculating unit 23 detects a level difference between the output from the HPF 17 and the output from the HPF 21, and calculates a coefficient to even up the difference to output it to the MPY 25. The coefficient calculating unit 23 has a configuration as shown in FIG. 2B. That is, the coefficient calculating unit 23 includes a first envelope detecting unit 31 serving as a first envelope detector, and a second envelope detecting unit 33 serving as a second envelope detector, an adder unit 35, a logarithmic-linear transformation unit 37 serving as an operation unit, and a low-pass filter (hereinafter called LPF) 39.

Further, the first envelope detecting unit 31 and the second envelope detecting unit 33 have a configuration as shown in FIG. 2C. That is, the first envelope detecting unit 31 and the second envelope detecting unit 33 include an absolute value calculating unit 41, a logarithmic transformation unit 43, a constant memory unit 45, a delay element 47, an adder unit 49, a comparative judgment unit 51, and a selector 53.

The absolute value calculating unit 41 calculates an absolute value of an input signal and outputs it to the logarithmic transformation unit 43.

The logarithmic transformation unit 43 outputs a value (a) in which the input value is transformed into a logarithm to the comparative judgment unit 51 and the selector 53. The logarithmic transformation unit 43 performs a general logarithmic transformation, and given that an input is "u" and a transformed value is "y," this can be derived by the following formula.

$$Y=20\log(u)$$

The constant memory unit 45 memorizes a constant (time constant) set in advance, and outputs this constant to the adder unit 49.

The delay element 47 retains a value of the previous sample 1 output from the selector 53, and outputs this value to the adder unit 49.

The adder unit 49 outputs a value (b) in which the constant output from the constant memory unit 45 is subtracted from the value of the previous sample 1 output from delay element 47, to the comparative judgment unit 51 and the selector 53.

The comparative judgment unit 51 compares the value (a) output from the logarithmic transformation unit 43 with the value (b) output from the adder unit 49. Then, in a case of a>b, the comparative judgment unit 51 outputs 0 to the selector 53, and in a case of a≦b, the comparative judgment unit 51 outputs 1 to the selector 53.

The selector 53 selects the value (a) output from the logarithmic transformation unit 43 or the value (b) output from the adder unit 49, and outputs it. That is, when the comparative judgment unit 51 outputs 0, the selector 53 outputs the value (a) output from the logarithmic transformation unit 43. Further, when the comparative judgment unit 51 outputs 1, the selector 53 outputs the value (b) output from the adder unit 49.

Inputs and outputs of the first envelope detecting unit 31 and the second envelope detecting unit 33 become waveforms as shown in FIG. 4B. Note that, an inclination of an envelope can be changed depending on a value of a constant (time constant) memorized in the constant memory unit 45. In the present invention, when a fluctuation in a value of a detected envelope is rapid, a sense of discomfort (sense of wobble) is brought to a listener, and when a fluctuation in a detected envelope is too slow, precise envelope detection cannot be achieved, which makes it impossible to follow up the input correctly. Therefore, as shown in FIG. 4B, an output value of the envelope is set so as to be gently attenuated at a certain time constant, and when a value greater than the value is input, the greater value is replaced as an output value.

Note that a value of the constant (time constant) memorized in the constant memory unit 45 may be set by an experiment or the like.

In the coefficient calculating unit 23, the first envelope detecting unit 31 derives an envelope on the basis of an instantaneous value of the input signal serving as band components with which the input signal is adjacent to the high-frequency band extension components, which are output from the HPF 21, and outputs it as a level value.

The second envelope detecting unit 33 derives an envelope on the basis of an instantaneous value of the input signal serving as the high-frequency band extension components of an alternating-current signal output from the HPF 17, and outputs it as a level value.

The adder unit 35 calculates a difference between the envelope at the level of the input 1 output from the first envelope detecting unit 31 and the envelope at the level of the input output from the second envelope detecting unit 33, and outputs the difference to the logarithmic-linear transformation unit 37.

The logarithmic-linear transformation unit 37 transforms the difference value (logarithmic value) output from the adder unit 35 into a linear value. Note that, in order to perform a multiplication in the MPY 25, it is necessary for a coefficient output from the level correction coefficient calculating unit 23 to be a linear value. Therefore, the values transformed into logarithms in the first envelope detecting unit 31 and the second envelope detecting unit 33 are retransformed in the logarithmic-linear transformation unit 37. Because transformation performed in the logarithmic-linear transformation unit 37 is opposite to logarithmic transformation, given that an input is "y" and a transformed value is "p," transformation can be achieved by the following formula.

$$p=10^{y/20}$$

The LPF 39 smoothes the value output from the logarithmic-linear transformation unit 37 to output it to the MPY 25. Note that, as shown in FIG. 4B, because the fluctuation when the value of the envelope is increased is rapid, the LPF 39 is for suppressing its fluctuation.

Note that the configuration of the level correction coefficient calculating unit 23 can be configured not to use a logarithmic difference. In such a case, the level correction coefficient calculating unit 23 may be configured such that the logarithmic transformation unit 43 and the logarithmic-linear transformation unit 37 are removed, and the adder unit 35 is changed to a divider.

As shown in FIG. 2A, the MPY 25 multiplies the coefficient output from the coefficient calculating unit 23 by the high-frequency band extension components output from the HPF 17, and outputs level-adjusted high-frequency band extension components serving as a product thereof to the ADDER 29. With this processing, the levels of the high-frequency band extension components output from the MPY 25 are controlled to be well-adapted to the level fluctuation at the high-frequency band end in the input signal so as to reduce its level difference.

The ADDER 29 adds the input signal and the level corrected high-frequency band extension components to output the added value.

The delay unit 27 delays the input signal in advance of the additive synthesis of the input signal and the high-frequency band extension component by the ADDER 29, to coordinate with a time delay taken by the processing for generating the high-frequency band extension components.

Figure 5:
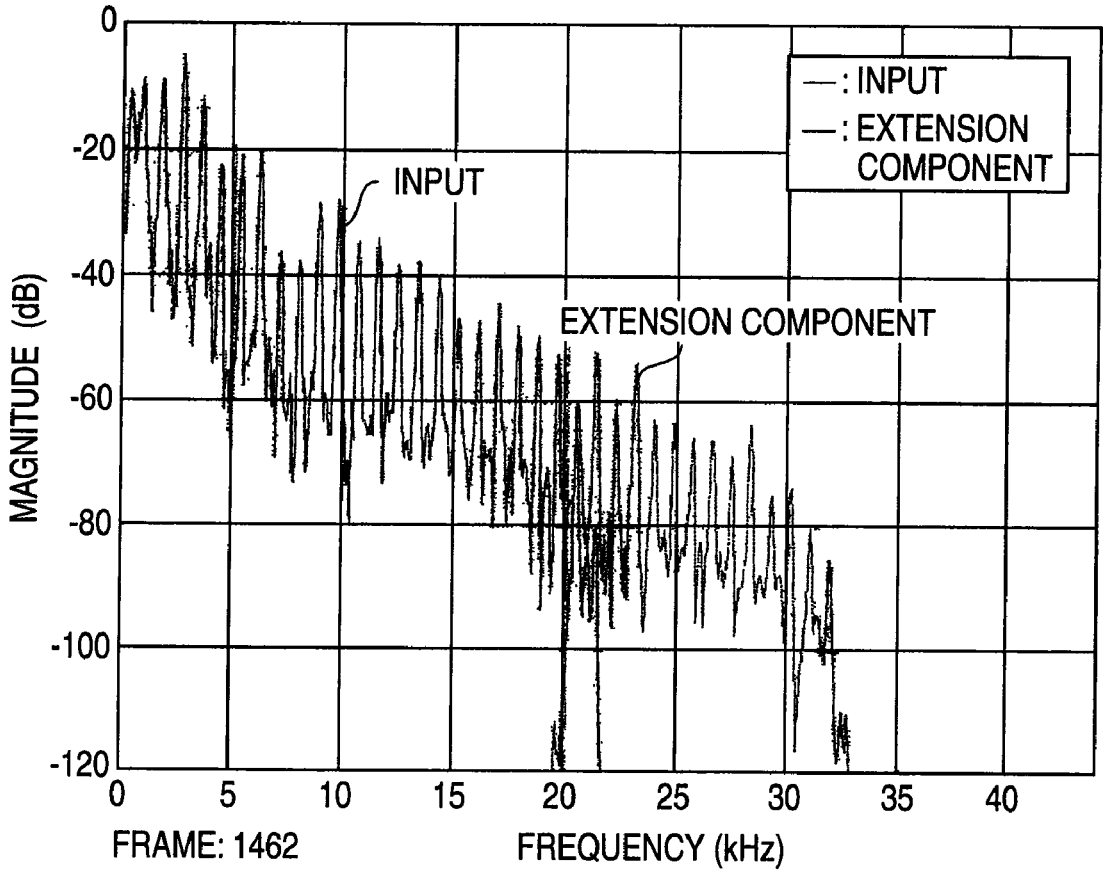
FIG. 5 is a graph showing a spectrum after band extension processing is performed on a band-limited audio signal by the reproducing apparatus.

In the reproducing apparatus 1, according to the configuration as described above, high-frequency band components are newly generated with respect to a signal whose high-frequency band is band-limited, and the high-frequency band components are added to the high-frequency band of the original input signal to reproduce the wideband frequency characteristic before the band limitations. FIG. 5 is a graph showing a spectrum after band extension processing is performed on a band-limited audio signal by the reproducing apparatus. In FIG. 5, a spectrum from 0 kHz to 22 kHz is the original audio signal (input signal), and a spectrum from 20 kHz to 33 kHz is the audio signal whose band is extended (high-frequency band extension components). As shown in FIG. 5, it can be understood that the audio signal after performing the additive synthesis does not have any unnecessary folding component, and its harmonic overtone series interval as well keeps the correct harmonic structure to be extended to a high-frequency band.

Figure 6:
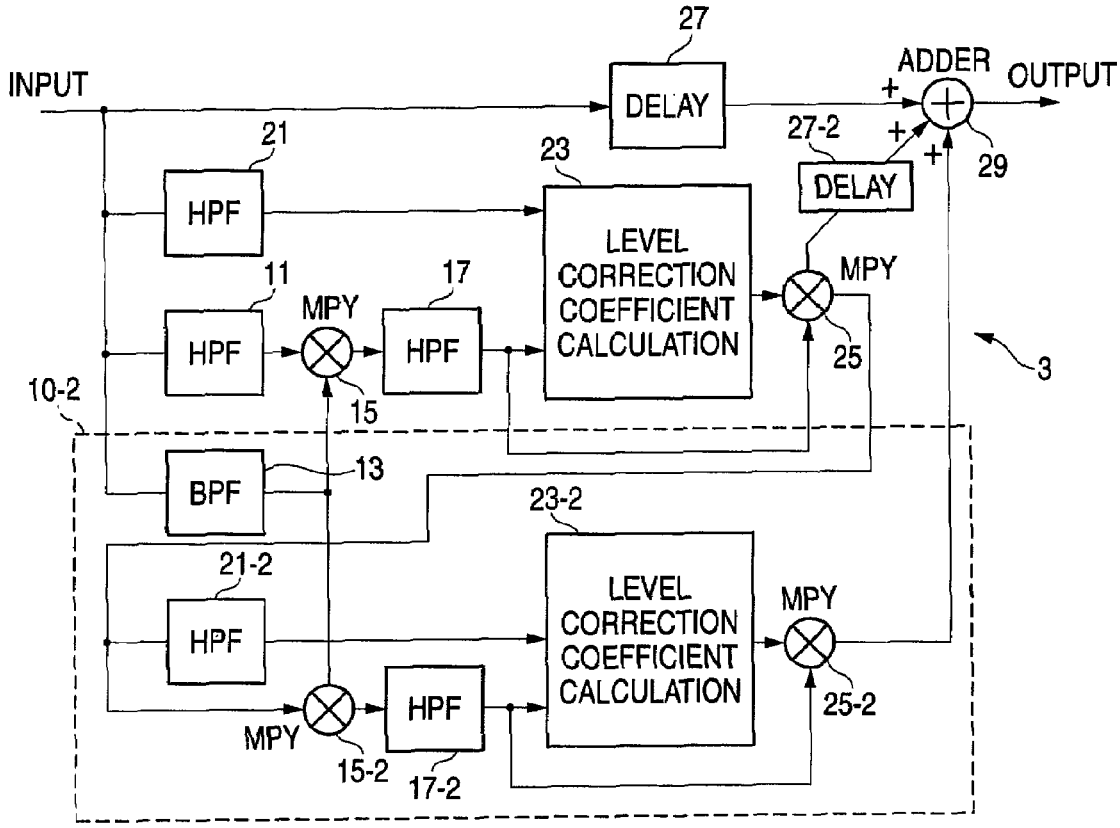
FIG. 6 is a block diagram illustrating the configuration to extend an audio signal to a higher-frequency band.
Figure 7:
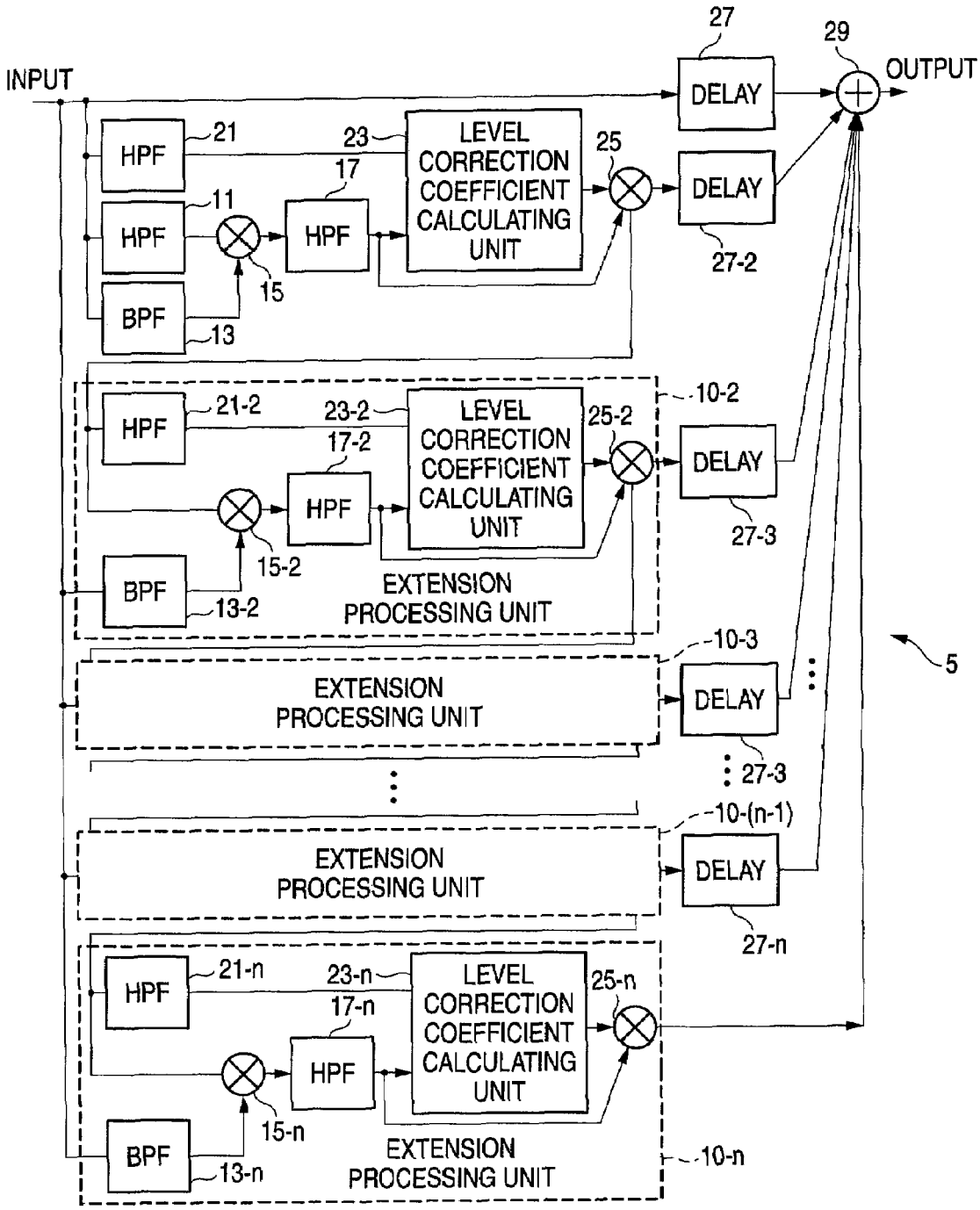
FIG. 7 is a block diagram illustrating the configuration of a band extension reproducing apparatus including a multistage high-frequency band extension component generating unit.

Next, another embodiment of the present invention will be described. When an attempt is made to extend a band of an audio signal to a higher-frequency band, the apparatus may be configured to perform the same processing on the high-frequency band components first extended. FIG. 6 is a block diagram illustrating the configuration to extend an audio signal to a higher-frequency band. FIG. 7 is a block diagram illustrating the configuration of a band extension reproducing apparatus including a multistage high-frequency band extension component generating unit.

A reproducing apparatus 3 shown in FIG. 6 has a configuration in which an extension processing unit 10-2 is added to the configuration of the reproducing apparatus 1 shown in FIG. 2A, and the extension processing unit 10-2 generates high-frequency band extension components to extend the input signal to a higher-frequency band from the level-adjusted high-frequency band extension components output from the MPY 25.

In FIG. 6, configurations which are the same as those of FIG. 2A are denoted by same reference numerals, and descriptions thereof will be omitted.

In the same way as the reproducing apparatus 1, the reproducing apparatus 3 includes the HPF 11, the BPF 13, the MPY 15, the HPF 17, the HPF 21, the coefficient calculating unit 23, the MPY 25, the delay unit 27, and the ADDER 29. Further, the reproducing apparatus 3 includes the extension processing unit 10-2 composed of an HPF 11-2 serving as a second high-frequency band component extraction unit, an MPY 15-2 serving as a second shifter, an HPF 17-2, an HPF 21-2 serving as a second adjacent component extraction unit, a level correction coefficient calculating unit (hereinafter called coefficient calculating unit) 23-2 serving as a second coefficient calculator, and an MPY 25-2 serving as a second level corrector.

Note that the extension processing unit 10-2 is configured to input components extracted by the BPF 13 serving as a part of the second shifter to the MPY 15-2. However, a BPF 13-2 may be newly provided therein.

The BPF 13 extracts components to shift the level-adjusted high-frequency band extension components output from the MPY 25 to a high-frequency band in proximity to 3 fs/4 of the components extracted by the HPF 11. That is, as aforementioned, the band components from 9.45 kHz to 12.6 kHz are extracted as a carrier as one example.

The MPY 15-2 multiplies an output from the MPY 25 serving as an input signal and an output from the BPF 13-2 serving as a carrier to frequency-shift the components extracted by the MPY 25 to a band in proximity to the maximum frequency of the low-order extension components.

The HPF17-2 extracts only the components shifted to the high-frequency band side among the output components from the MPY 15-2 to output those to the coefficient calculating unit 23-2 and the MPY 25-2. A cutoff frequency is set to a frequency slightly lower than 3 fs/4. Thereby, high-frequency band extension components (high-order extension components) whose band components are 3 fs/4 to fs are generated.

The HPF 21-2 extracts a band (band components) in which the low-order extension components are adjacent to the high-frequency band extension components in order to adjust the levels at an interface between the high-frequency band extension components and the low-order extension components to finely connect those. For example, a value of approximately 2 fs/3 is set as a cutoff frequency to the HPF 21-2.

The coefficient calculating unit 23-2 detects a level difference between an output from the HPF 17-2 and an output (band components) from the HPF 21-2, and calculates a coefficient to even up the difference to output it to the MPY 25-2. Note that the coefficient calculating unit 23-2 has a configuration which is the same as that of the coefficient calculating unit 23.

The MPY 25-2 multiplies the coefficient output from the coefficient calculating unit 23-2 by the high-frequency band extension components output from the HPF 17-2, and outputs level-adjusted high-frequency band extension components serving as a product thereof to the ADDER 29.

The ADDER 29 adds the input signal output from the delay unit 27, the high-frequency band extension components output from the delay unit 27-2, and the high-frequency band extension components output from the MPY 25-2 to output it.

The delay unit 27-2 delays the input signal in advance of the additive synthesis of the input signal and the respective high-frequency band extension components by the ADDER 29, to coordinate with a time delay taken by the processing for generating the high-frequency band extension components.

In accordance therewith, the high-frequency band extension components generated from the input signal and the high-frequency band extension components generated from the high-frequency band extension components output from the MPY 25 can be added to the input signal to generate a signal with a wider-band frequency characteristic.

Note that the components output from the MPY 25 are based on the high-frequency band components of the input signal extracted by the HPF 11, which hardly includes unnecessary signals. Therefore, a filter corresponding to the HPF 11 is not provided to the extension processing unit 10-2.

Next, in a case in which a signal with a wider-band frequency characteristic is generated, a plurality of extension processing units may be provided at the subsequent stage of the extension processing unit 10-2 of the reproducing apparatus 3 shown in FIG. 6. That is, as shown in FIG. 7, provided that n-stage extension processing units 10-3 to **10-*n* by using components output from an extension processing unit at the previous stage as an input signal are provided at the subsequent stage of the extension processing unit 10-2**, it is possible to generate a signal with a wider-band frequency characteristic.

In a reproducing apparatus 5 shown in FIG. 7, the extension processing units 10-3 to **10-*n* have configurations which are the same as that of the extension processing unit 10-2. Further, the high-frequency band extension components output from the respective extension processing units 10-3 to 10-(*n*-1) except for the final-stage extension processing unit 10-*n* are respectively processed to be delayed so as to match the timing of outputting the respective high-frequency band extension components and the input signal by the delay units 27-3 to 27-*n*, and additive synthesis of those is performed in the ADDER 29**.

Note that the reproducing apparatus 5 is provided with the configuration in which BPFs 13-2 to **13-*n* are provided to the respective extension processing units. However, the reproducing apparatus 5 may be configured to input an output from the MPF 13 to the respective BPFs 15-2 to 15-*n***.

Figure 1B:
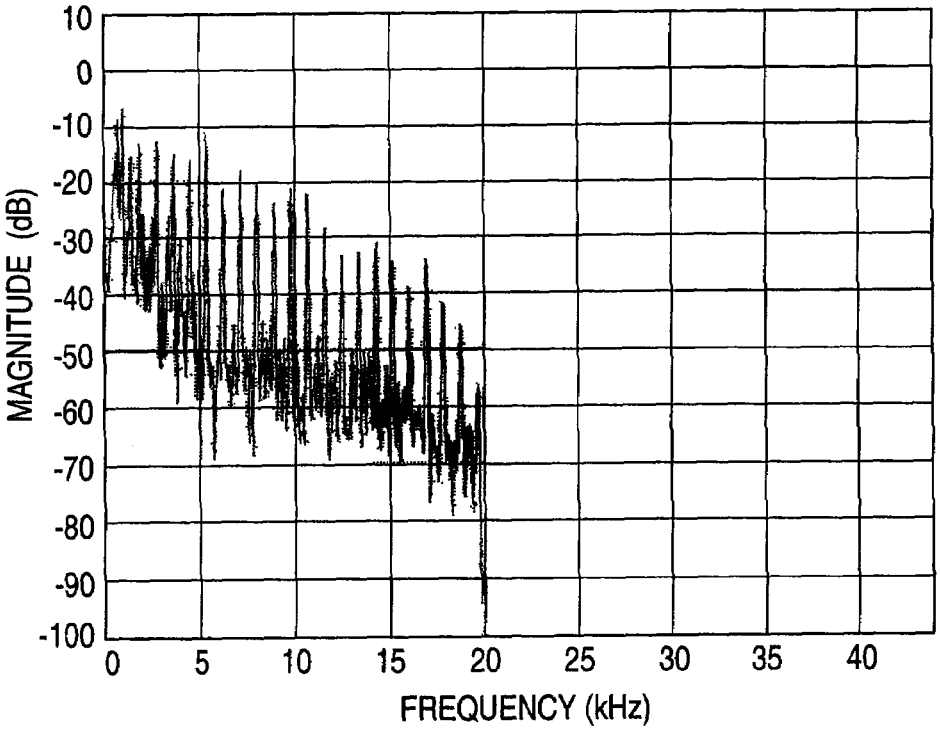
Figure 8A:
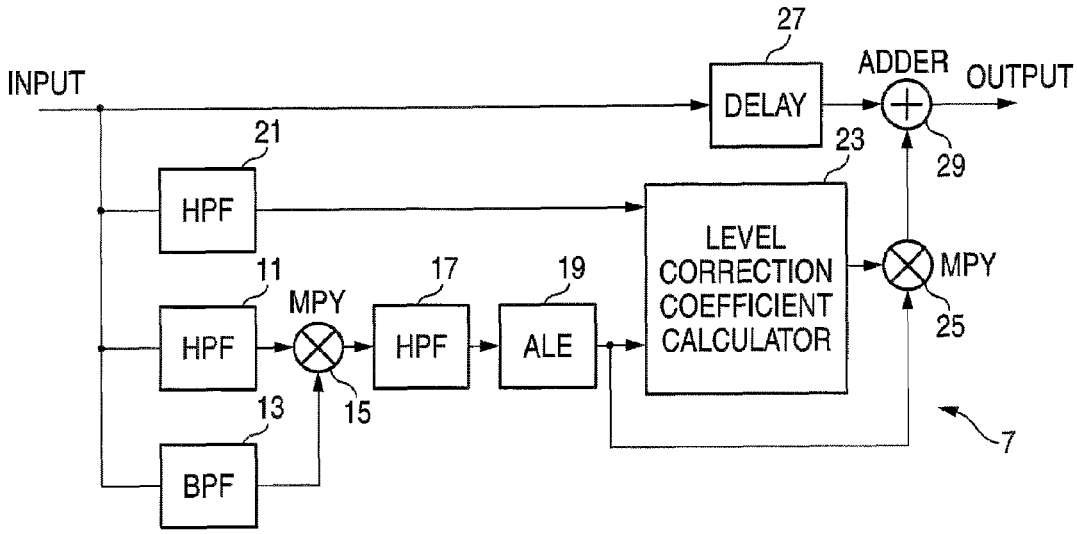
FIG. 8A is a block diagram illustrating the configuration of a reproducing apparatus including an adaptive line enhancer.
Figure 8B:
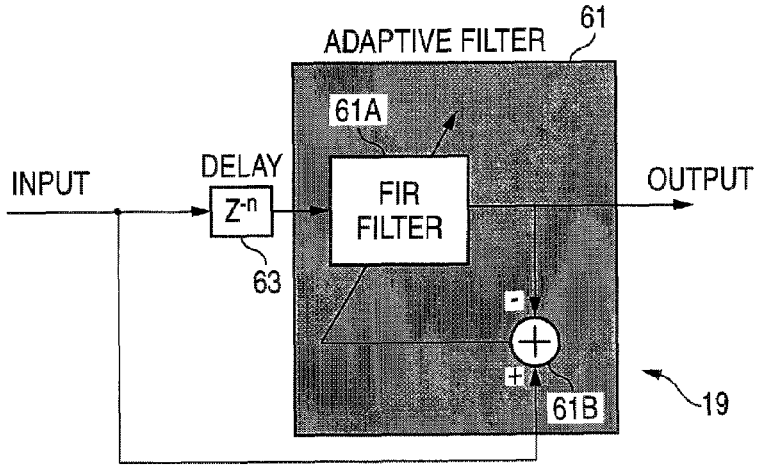
FIG. 8B is a block diagram illustrating the configuration of the adaptive line enhancer.

Next, yet another embodiment of the present invention will be described. FIGS. 8A and 8B are block diagrams of a reproducing apparatus including an adaptive line enhancer, and a block diagram illustrating the configuration of the adaptive line enhancer. A reproducing apparatus 7 shown in FIG. 8A is provided with an adaptive line enhancer (Adaptive Line Enhancer: hereinafter called ALE) 19 serving as a line spectrum enhancing unit between the HPF 17 and the coefficient calculating unit 23, and the other configurations thereof are the same as those of the reproducing apparatus 1 shown in FIG. 1. Therefore, only the ALE 19 will be hereinafter described.

The ALE 19 is a type which is the same as that generally used, and as shown in FIG. 8B, the ALE 19 is composed of an adaptive filter 61 composed of an FIR filter 61A and an adder 61B, and a delay device 63. Because the adaptive filter 61 operates so as to eliminate uncorrelated signals from an input signal and to output highly correlated components, it is possible to suppress uncorrelated components of an output from the HPF 17 to enhance harmonic components composed of a harmonic overtone series. Therefore, harmonic overtone series whose unnecessary components are suppressed can be used as a carrier, which makes it possible to prevent unnecessary components from being generated in an output due to the frequency-shift and multiplication. The configuration of the adaptive filter is not especially regulated. However, in view of load of real-time operation, an LMS algorithm or an NLMS algorithm is preferable in reality. A number of taps of the filter and a size of a step for updating a coefficient may be determined appropriately by an experiment in view of an allowable processing capacity and effect. Further, a size of delay may be tested to determine an effective one within a range from 1 to 10-odd samples. An effective number of delays is derived for every music genre to be reproduced, and a user may be allowed to switch them.

Note that, by providing the ALE 19 to the reproducing apparatus 3 shown in FIG. 6 or the respective extension processing units 10-1 to **10-*n* of the reproducing apparatus 5 shown in FIG. 7** in the same way, the same advantageous effect can be obtained.

As described above, in the band extension reproducing apparatus of the present invention, high-frequency band components having a correct harmonic structure are generated from an input signal by processing only within a time domain in which processing load is relatively light, and those are added to a high-frequency band of the input signal to reproduce a wideband frequency characteristic, which makes it possible to provide sound with greater natural listening characteristics.

Note that, in the above descriptions, the case in which a concrete value as a sampling frequency fs is 44.1 kHz has been described as an example. However, the present invention is not limited to this example, and it is as a matter of course that another value may be used.

Further, in the above descriptions, the case in which processing for making an audio signal whose high-frequency band is band-limited to have a wider-band by the band extension reproducing apparatus has been described. However, the present invention is not limited to this case, it is possible to apply any processing for generating a signal with a wideband frequency characteristic such that high-frequency band components are newly generated with respect to an input signal to add those to a high-frequency band of the input signal regardless of whether the high-frequency band is band-limited or not. For example, by applying this invention to an MP3 audio player, it is possible to restore harmonic overtone components in a high-frequency band lost in encoding.

What is claimed is:

1. A band extension reproducing apparatus comprising:

a high-frequency band component extraction unit which extracts, from an input signal, a high-frequency band component at a predetermined frequency or more;

a first shifter which acquires information on a harmonic overtone series interval from the input signal, and shifts frequency of the extracted high-frequency band component on the basis of the acquired information to generate first high-frequency band extension component; and an adder which adds the generated first high-frequency band extension component to the input signal.

2. The band extension reproducing apparatus according to claim 1, further comprising:

a level corrector which corrects levels of the generated first high-frequency band extension component so as to be adapted to a level fluctuation in the input signal to even up a level difference; and a delay unit which delays the input signal to adjust a timing of supplying the input signal and an output signal from the level corrector to the adder, wherein the adder adds the input signal delayed by the delay unit and the first high-frequency band extension component output from the level corrector.

3. The band extension reproducing apparatus according to claim 2, further comprising a single-stage or multistage extension processing unit, wherein the multistage extension processing unit includes:

a second shifter which:

acquires information on a harmonic overtone series interval from the input signal, when the extension processing unit is not connected to the previous stage, shifts frequency of the first high-frequency band extension component corrected by the level corrector to a band in proximity to a maximum frequency among the first high-frequency extension component on the basis of the information, when the extension processing unit is connected to the previous stage, shifts a frequency of a second high-frequency band extension component output from the extension processing unit to a band in proximity to a maximum frequency among the second high-frequency extension component on the basis of the information, and outputs a third high-order extension component frequency-shifted from the first or second high-frequency band extension component;

an adjacent component extraction unit which extracts a band component, which is adjacent to the third high-order extension component, from the first or second high-frequency band extension component;

a coefficient calculator which calculates a coefficient to correct levels of the third high-order extension component on the basis of the third high-order extension component output from the second shifter and the band component output from the adjacent component extraction unit; and a second level corrector which corrects levels of the third high-order extension component output from the second shifter so as to be adapted to a level fluctuation in the first or second extension component on the basis of the coefficient calculated by the coefficient calculator to reduce a level difference, wherein the adder adds the input signal, the first high-frequency band extension component output from the level corrector and the third extension component, and the third high-order extension component output from the second level corrector, and wherein the delay unit delays the input signal and the high-order extension component from the respective extension processing unit except for the last-stage one, to adjust the timing to supply the input signal and the high-order extension component to the adder.

4. The band extension reproducing apparatus according to claim 2, further comprising:

an adjacent component extraction unit which extracts, from the input signal, a band component which is adjacent to the first high-frequency band extension component; and a coefficient calculator which calculates a coefficient to correct levels of the first high-frequency band extension component on the basis of the first high-frequency band extension component output from the shifter and the band component output from the adjacent component extraction unit, wherein the level corrector corrects levels of the first high-frequency band extension component output from the shifter so as to be adapted to a level fluctuation in the input signal to even up a level difference on the basis of the coefficient calculated by the coefficient calculator.

5. The band extension reproducing apparatus according to claim 1, wherein the shifter includes:

a carrier extraction unit which extracts a band component within a constant range centering on a frequency obtained by subtracting the predetermined frequency from a frequency in the first high-frequency band extension component; and an extension component generator which multiplies the frequency band component extracted by the high-frequency band component extraction unit by the carrier component extracted by the carrier extraction unit to output the first high-frequency band extension component in which frequency of the high-frequency band component is shifted to a high-frequency band.

6. The band extension reproducing apparatus according to claim 5, wherein the carrier extraction unit extracts a minimum range including at least one of integer-order harmonic components of a fundamental pitch of a musical instrument by necessity whatever frequency is selected, as the band component within a constant range.

7. The band extension reproducing apparatus according to claim 4, wherein the coefficient calculator includes:

a first envelope detector which derives an envelope on the basis of an instantaneous value of a band component extracted by the adjacent component extraction unit, which is adjacent to the first high-frequency band extension component, and outputs it as a first level value, a second envelope detector which derives an envelope on the basis of an instantaneous value of the first high-frequency band extension component output from the shifter, and outputs it as a second level value, and an operation unit which detects a level difference between the first and second output values to calculate a coefficient for correcting levels of the high-frequency band extension component so as to even up the difference.

8. The band extension reproducing apparatus according to claim 1, further comprising a line spectrum enhancing unit which eliminates uncorrelated signals from the input signal to output a highly-correlated component at a subsequent stage of the shifter.

* * * * *